US007403109B2

(12) United States Patent
Martin

(10) Patent No.: US 7,403,109 B2
(45) Date of Patent: Jul. 22, 2008

(54) METHOD OF REDUCING FALSE ALARMS DURING AUTO-ARM

(75) Inventor: Christopher D. Martin, Plainview, NY (US)

(73) Assignee: Honeywell International Inc., Morristown, NJ (US)

( * ) Notice: Subject to any disclaimer, the term of this patent is extended or adjusted under 35 U.S.C. 154(b) by 299 days.

(21) Appl. No.: 11/408,533

(22) Filed: Apr. 21, 2006

(65) Prior Publication Data

US 2007/0247302 A1 Oct. 25, 2007

(51) Int. Cl.
*G08B 29/00* (2006.01)

(52) U.S. Cl. ..... 340/516; 340/506; 340/507

(58) Field of Classification Search ..... 340/506, 340/507, 516, 517, 520, 523, 527, 540, 541
See application file for complete search history.

(56) References Cited

U.S. PATENT DOCUMENTS 4,808,972 A * 2/1989 Nicholls ..... 340/541
5,216,410 A * 6/1993 Pildner et al. ..... 340/509
5,475,365 A * 12/1995 Hoseit et al. ..... 340/522
5,581,236 A * 12/1996 Hoseit et al. ..... 340/511

* cited by examiner

*Primary Examiner*—Van T. Trieu
(74) *Attorney, Agent, or Firm*—Scully, Scott, Murphy & Presser, P.C.

(57) ABSTRACT

A method for reducing false alarms for a security system when the security system is programmed to automatically arm the security system. The method reduces false alarms by preventing the security system to auto-arm the system in away mode based upon certain detected events within the premises. The method comprise the steps of determining if a current time equals or is within a predetermined detection period, judging whether at least one of a plurality of motion sensors have detected an event within a protected area during the predetermined detection period, determining if a premises exit signal has been generated within a predetermined period from said detected movement, generating an automatic arm adjustment signal based upon said detected event and the premises edit signal; and executing a modification to the programmed automatic arm based upon the automatic arm adjustment signal. The method will also notify the owner that the auto-arm mode failed.

13 Claims, 6 Drawing Sheets

METHOD OF REDUCING FALSE ALARMS DURING AUTO-ARM

BACKGROUND OF THE INVENTION

1. Field of Invention

The invention relates to a method for reducing false alarms generated by a security system located in a commercial or residential property. More particularly, the invention is related to a method for reducing false alarms where a security system is programmed to automatically arm the security system at a predetermined time schedule and at least one person is still within the premises.

2. Background

Security systems, such as for homes and businesses, have become commonplace as people seek to protect themselves and their property. A security system includes any life, safety, and property protection system. A security system typically includes an installed security system and a central monitoring station. The installed security system includes a control panel, a user interface device and a plurality of sensors. The sensors can includes smoke, carbon monoxide, motion, and burglary. There are perimeter and interior sensors where each perimeter and interior sensor protects a specific zone within the premises. The perimeter sensors protect the external zones of the premises, e.g., outside, doors, windows. The interior sensors protect the internals of the premises, e.g. motion detection within the building.

The installed security system can operate in various modes of protection, such as arm or disarm. There are also various types of armed modes. For example, stay, stay-night, instant, away, and maximum are some of the operational modes for armed. Depending on the mode of operation, certain types of sensors are activated for detection. For example, in stay mode, the perimeter sensors will be activated to generate an alarm and the interior sensors not activated and any motion that would be detected will not generate an alarm. The arm-stay mode is used when a person is within the premises or a pet is within the premises but some protection is desired. An alarm would be generated if any of the window or entry point sensors detect motion, i.e., opened. In away mode, both the interior and perimeter sensors are armed. This mode is used when a person is away from the premises. An alarm would be generated if any of the sensors detect motion. Similar detection parameters can be configured for the other types of mode.

A user can modify the mode of operation using a user interface device such as a keypad. Additionally, a user can program the security system to schedule certain types of events such as automatically activating or deactivating of the mode of operation. Specifically, this feature can be used to automatically arm the system in stay mode at a specific scheduled time, automatically arm the system in away mode at a specific scheduled time, and automatically disarm the system at a specific scheduled time. This feature is particularly important in a commercial business where the business closes at a specific time everyday. The user will not have to remember to arm the security system daily. The user will select, using the user interface device, the type of event, input the time for that event and select how often the event should be repeated, i.e., daily, weekly, or monthly.

When the scheduled time is reached, the security system will perform the programmed event such as automatically arming the system. Optionally, prior to arming, the system can provide an auto-arm message within a warning period. The user interface device can emit an audible warning tone (message) or display a visual warning to anyone within the premises that the auto-arm is about to take place. However, the system can execute the auto arm even though there may be a person or pet still within the premises. This will result in one of the sensors, i.e., perimeter or interior, detecting motion. The sensors will transmit a signal to the control panel to generate an alarm. The control panel will transmit an alarm message to the central monitoring station. This generated alarm is a false alarm. However, by law, the central monitoring station will have to respond to the alarm even though it is a false alarm resulting in a waste of time and resources.

Accordingly, there is a need to be able to reduce the number of false alarms caused by automatically arming the system even though there is a person within the premises.

BRIEF SUMMARY OF THE INVENTION

Accordingly, provided is a method for reducing false alarms for a security system when the security system is programmed to automatically arm the security system. The method reduces false alarms by preventing the security system to auto-arm the system in away mode based upon certain detected events within the premises. The method comprise the steps of determining if a current time equals or is within a predetermined detection period, judging whether at least one of a plurality of motion sensors have detected an event within a protected area during the predetermined detection period, determining if a premises exit signal has been generated within a predetermined period from said detected movement, generating an automatic arm adjustment signal based upon said detected event and the premises edit signal; and executing a modification to the programmed automatic arm based upon the automatic arm adjustment signal. The method will also notify the owner that the auto-arm mode failed.

The security system will cancel the automatic arm, if both the event is detected and no premises exit signal has been generated.

Alternatively, the security system will first determine which type of sensor detected the event. The type of sensor can be either a perimeter sensor or an interior sensor. An event can be motion if the sensor is an interior sensor. However, if the sensor is an exterior sensor, the event can be the opening or closing of a door or window or the breakage of glass within a window. After the security system determines the type of sensor, the security system can decide to execute the automatic arm of the security system in arm-stay mode, if the sensor that detected the event is determined to be said interior sensor only and no premises exit signal has been generated.

Alternative, if both the event is detected and no premises exit signal has been generated, the security system can delay the automatic arm process. The delay is for a predetermined period of time. After this predetermined period of time elapses, the auto-arm procedure is repeated, as the security system will determine if a event is detected. The auto-arm process can be repeated for N times. If after N times the event is still detected, the security system can cancel the automatic arm.

Any change in the auto-arm process is reported to the central monitoring station and then to the owner of the security system.

DETAILED DESCRIPTION OF THE INVENTION

Figure 1:
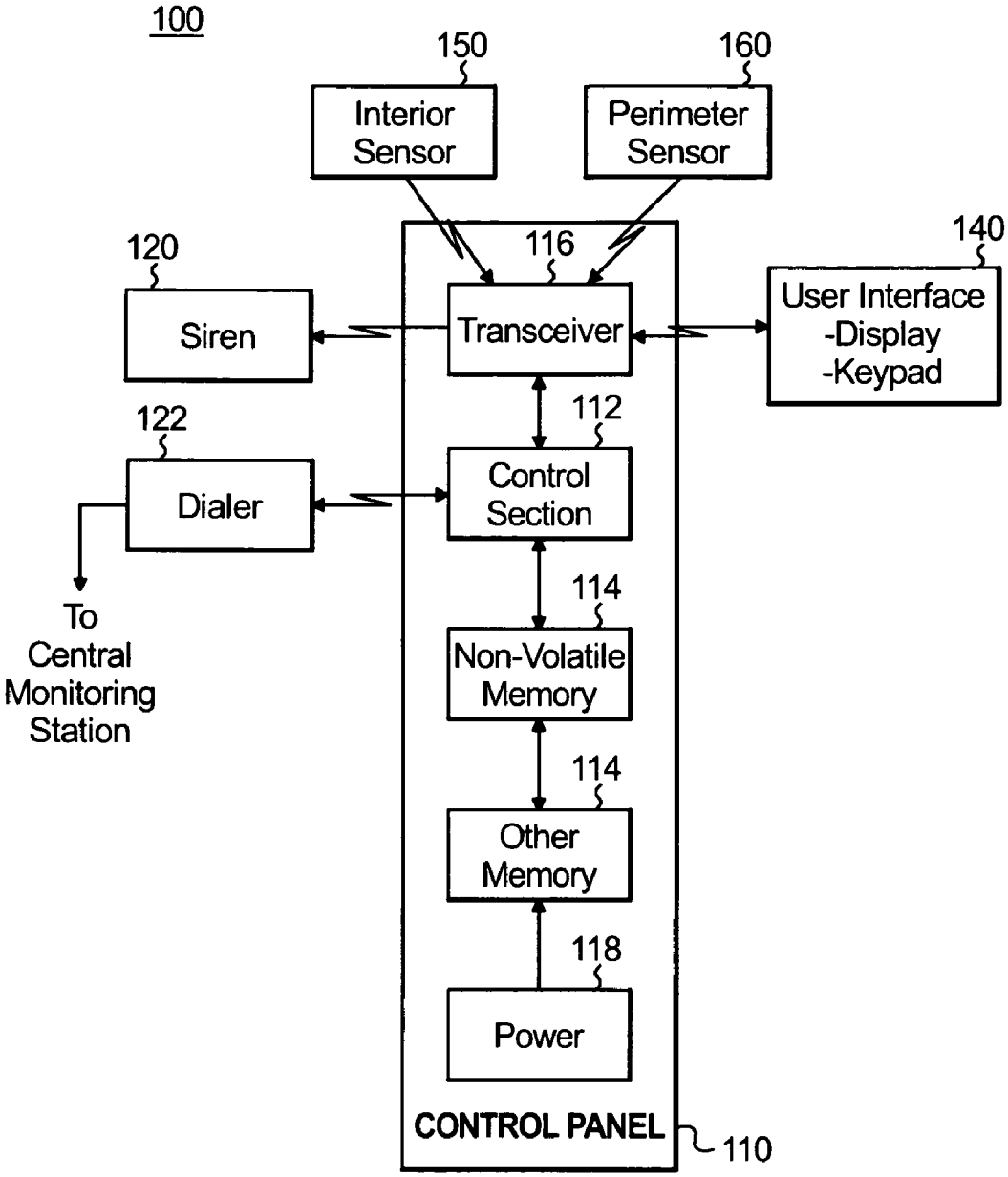
FIG. 1 illustrates an exemplary security system according to the invention.
Figure 2:
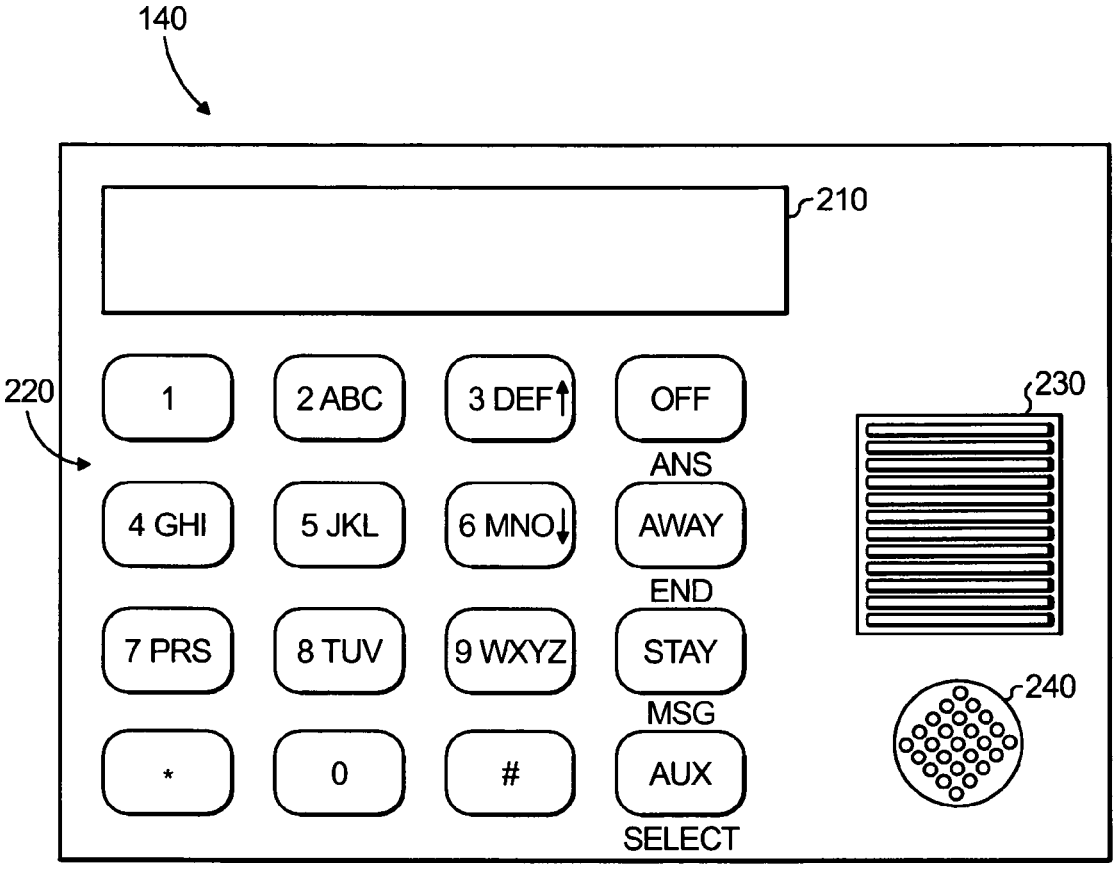
FIG. 2 illustrates an example of a user interface device according to the invention.
Figure 3:
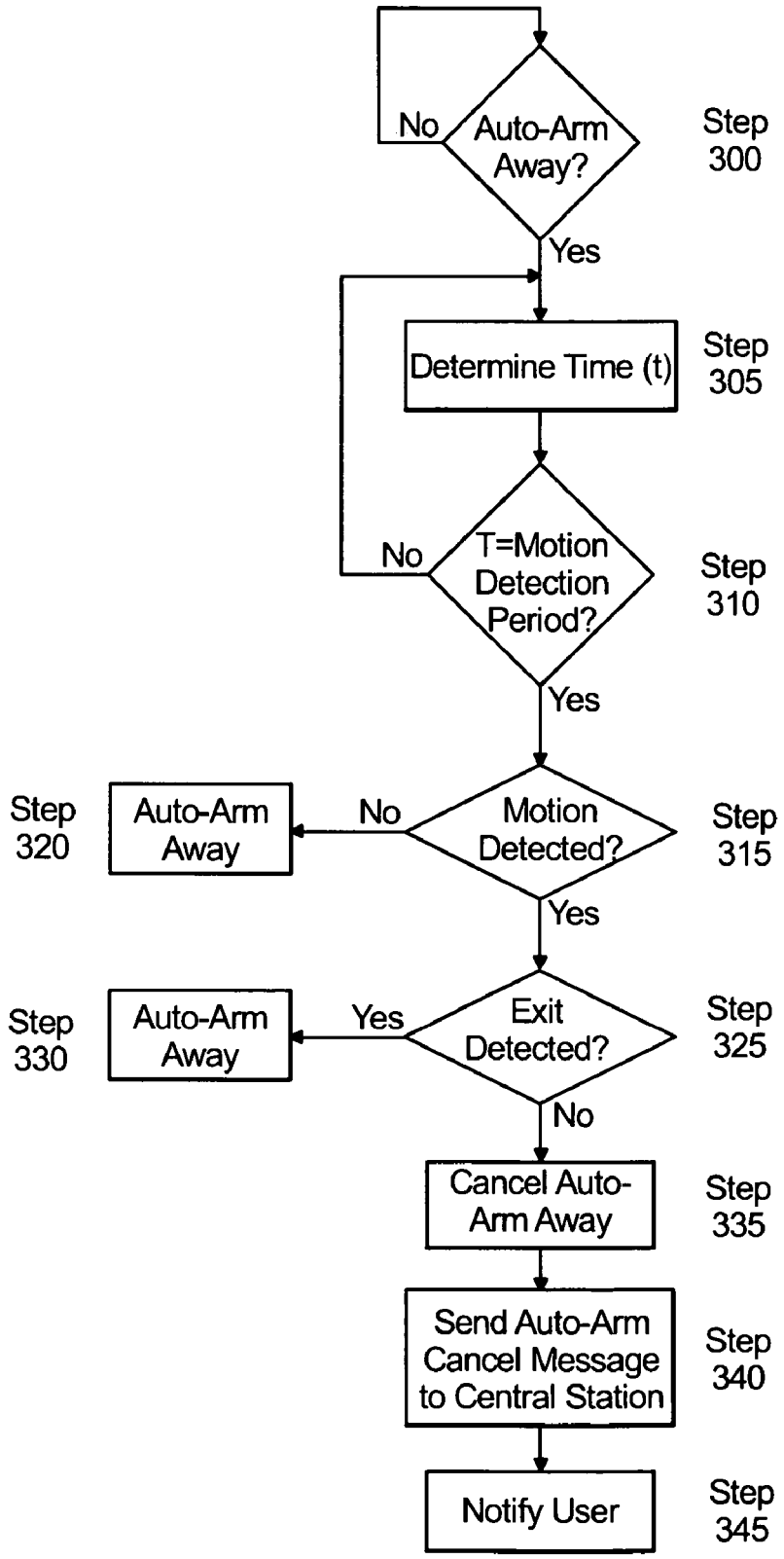
FIG. 3 illustrates the method of reducing false alarms according to the first embodiment of the invention.

FIG. 1 illustrates an exemplary security system according to the invention. A security system 100 includes a control panel 110 that communicates with a plurality of interior sensors 150 and perimeter sensors 160 via a wired or wireless path. The perimeter sensors 160 can be door or window contacts sensors, shock detectors and glass breakage detectors. The interior sensors 150 can be motion sensors, microwave sensors, such as Doppler sensors, infrared sensors, motion sensitive cameras, and pressure mats.

For example, the control panel 110 may receive signals from motion sensors that detect when a person enters a room. Signals received from fire sensors, such as smoke or heat sensors, indicate that a fire has been detected. Signals received from window and door sensors indicate that a window or door has been opened. The control panel 110 includes a control section 112, which can be a microprocessor, memory 114, a power source 118 and a transceiver 116, and a dialer 122.

The control section 112 includes a memory 114 for storing software or other instructions that are executed by the control section 112 to achieve the functionality described herein may be considered a program storage device.

The control section 112 also includes an external clock that maintains the time and date for the security system 100. Additionally, the control section 112 can include a timing means and a comparison means to implement the functionality described herein. The control panel 110 may also transmit signals to components of the security system 100 via a wireless transceiver 116. For example, signals may be transmitted to a siren 120 to activate the siren when an alarm condition is detected. Signals may be sent to the user interface device 140 to display status information to the user, such as whether the system is armed or disarmed, or whether a specific door or window has been opened.

The control panel 110 can include a user interface device 140 integrated with the control panel 110 or a separate peripheral device can be connected to the control panel 110. The user interface device 140 is commonly provided in the home such as by affixing it to a wall or placing it on a table, for instance, while the control panel 110 generally is a larger component that may be installed, e.g., in a closet or basement. However, it is not necessary for the user interface device 140 to be separate from the control panel 110, or to communicate by wireless signals with the control panel 110. For example, the user interface device 140 may be integrated into the control panel 110. Optionally or additionally, a user interface device may be hardwired to the control panel 110.

Signals received from a peripheral user interface device 140, e.g., including a keypad and display, may arm and disarm the system, as well as trip an alarm via a panic button feature, and schedule events. Typically, the user interface device 140 is the primary interface between the human user and the security system 100. The user interface device 140 typically includes components that are analogous to the control panel 110, including a control, memory and power source. Optionally, the user interface device 140 includes a transceiver.

As mentioned, the user interface device 140 can be provided, e.g., as a peripheral to the main control panel 110, or as part of the main control panel 110. Thus, the functionality that is described herein as being provided by a user interface device may be provided wholly locally to the device 140, or partially remotely, such as at the associated control panel 110. The user interface device 140 includes a user input component such as a keypad 220 and/or microphone 240 for speech recognition in a voice-activated system, and a user output component such as a display 210 and/or speaker 230. The display 210 may be a multi-line, multi-character LCD display, for instance. Additionally, user interface device 140 can include a graphic keypad user interface.

When the user enters the desired commands for controlling the security system 100, a transmitter associated with the user interface device 140 sends a user-generated signal via a wireless and/or wired path that is encoded with the user-selected command. Alternatively, the user interface device can be a user-operated transmitter may be a handheld portable transmitter such as a key fob transmitter.

The user can use the user interface device 140 to program a schedule for the security system 100 to arm or disarm automatically. Alternatively, the security system 100 can be instructed to arm or disarm automatically via a remote computer such computer including Compass Downloader Software. The user will select the specific mode of operation, e.g., stay or away. Then the user will input a specific time for the arming of the mode and whether the activation should be repeated. Once the system has been programmed, the security system 100 will automatically activate the selected mode when the scheduled time is reached only if certain predefined conditions exist, e.g., no motion.

Prior to automatically activating the selected mode, the system will determine if there is motion within one of the protected zones. Based upon this determination the control panel 110 will decide whether to continue with the arming process. FIGS. 3-6 illustrate four different embodiments for reducing false alarms when the security is programmed for auto-arm away mode according to the invention. Like steps are labeled the same across all four figures.

In the first embodiment, if the system detects both motion and no premises exit, then the system will cancel the auto-arm process. A premises exit is a signal that indicates that one of a plurality of predefined doors has been opened, in an entry/exit zone. This signal means that a person has left the premises.

At step 300, the control panel 110 will determine if the user has programmed or scheduled an automatic arm of the away mode (hereinafter "Auto-Arm Away"). If the result of the determination is "yes" then the control panel 110 will determine the current time, at step 305. An internal clock within a microcontroller 112 maintains the current time. The current time is compared, using a comparison means, with the predefined detection period or Auto-Arm warning period, at step 310. The Auto-Arm warning period is the time period where the system can warn the user that the system is about automatically arm itself. The period of time is directly prior to the auto-arm time, e.g., 30 minutes. A security system that is capable of this Auto-Arm warning period will either emit a tone and/or display a warning message. The Auto-Arm warning period is a preset value that is stored in memory 114. The period can range from just a few minutes to an hour or more. The Auto-Arm warning period is a programmable time in minutes. The predefined detection period can be the same time as the Auto-Arm warning period, or a sub-set thereof. The user can define the predefined detection period. Where a security system is not capable or does not include the auto-arm warning period, the predefined detection period will be input by the user. Once input, the predefined detection period is stored in memory 114. For example, the predefined detection period can be 15 minutes prior to the auto-arm time.

At step 310, the control panel 110 will retrieve from memory 114, the scheduled auto-arm time and either the Auto-Arm warning period or predefined detection period. The control section, e.g., microprocessor 112, using the comparison means, will determined if the current time is equal to or within the predefined detection period. If the current time is not within the predefined detection period or Auto-Arm warning period then the system will wait until the current time reaches either predefined detection period or Auto-Arm warning period and return to step 305. If the current time is equal to or within the predefined detection period or Auto-Arm warning period, then the control panel 110 will determine if anyone is within the premises, at step 315. Specifically, the control panel 110 will check to see if any of the plurality of sensors, both interior 150 and perimeter 160 have transmitted a signal indicating motion. The control panel 110 will continuously monitor all incoming signals from the sensors for the entire predefined detection period or Auto-Arm warning period. If no motion is detected, then the control panel 110 will cause the system to automatically arm in away mode, at step 320.

If motion is detected then the control panel 110 will determine if anyone has left the premises, at step 325. This is done to determine if a person leaving the premises caused the detected motion within a predetermine time after the detected motion. The predetermined time will be determined by the time that motion was detected and the auto-arm time. The control panel 110 will check to see if any of the entry/edit zones transmits a signal indicating the opening and closing of a door prior to the auto-arm time. If the control panel determines that a premises exit signal was received, and that there was no motion after the premises exit signal, then the control panel will cause the system to automatically arm in away mode, at step 330.

If motion is detected, at step 315 and no premises exit detection signal was transmitted to the control panel, then the control panel will cause the system to ignore or cancel the scheduled auto-arm, at step 335. In other words, if during the predefined detection period or auto-arm warning period motion is detected within the premises and nobody leaves the premises through an exit door by the end of the predefined detection period or auto-arm warning period, the auto-arm will not occur. This will prevent the system from being auto-armed in the away mode while people are present in the premises, home or business. As a result, false alarms are reduced. The control panel 110 can transmit a message to the central monitoring station, at step 340, notifying them that the auto-arm failed using the primary communication means e.g., plain old fashion telephone system ("POTS") or communication network, i.e., dial-up hard-wire communications, using the telephone dialer 122. The communication network can include a computer network such as the Internet. For instance, the installed security systems may use a communications protocol such as TCP/IP to communicate with the central monitoring station. Other communication paths such as satellite or RF radio paths, including, e.g., those using GSM or CDMA techniques may also be used. In addition, the different communication paths may be attempted serially until a successful communication is made. The message can be a predetermined failure message, a page or an email.

Additionally, the control panel 110 can notify the user, e.g., owner of the system, that the system did not arm. This notification can be message sent to a pager, cellular phone or email based upon a programmed notification parameter. This method can be performed in the manner described in United States Patent Publication Number, 2005/0146430 dated Jul. 7, 2005, and assigned to Honeywell International, Inc. The reference is incorporated by reference. The user when inputting the auto-arm schedule can program a notification number or parameter such that when there is a failure in the auto-arm process, a notification will be sent to that number or parameter. The parameter can be a pager number, email address, cellular phone or any other contact point.

According to a second embodiment, if the system detects both motion and no premises exit, then the system can prevent the system from executing the auto-arm away mode, but rather executing an auto-arm stay mode depending on the location of the detected motion.

Figure 4:
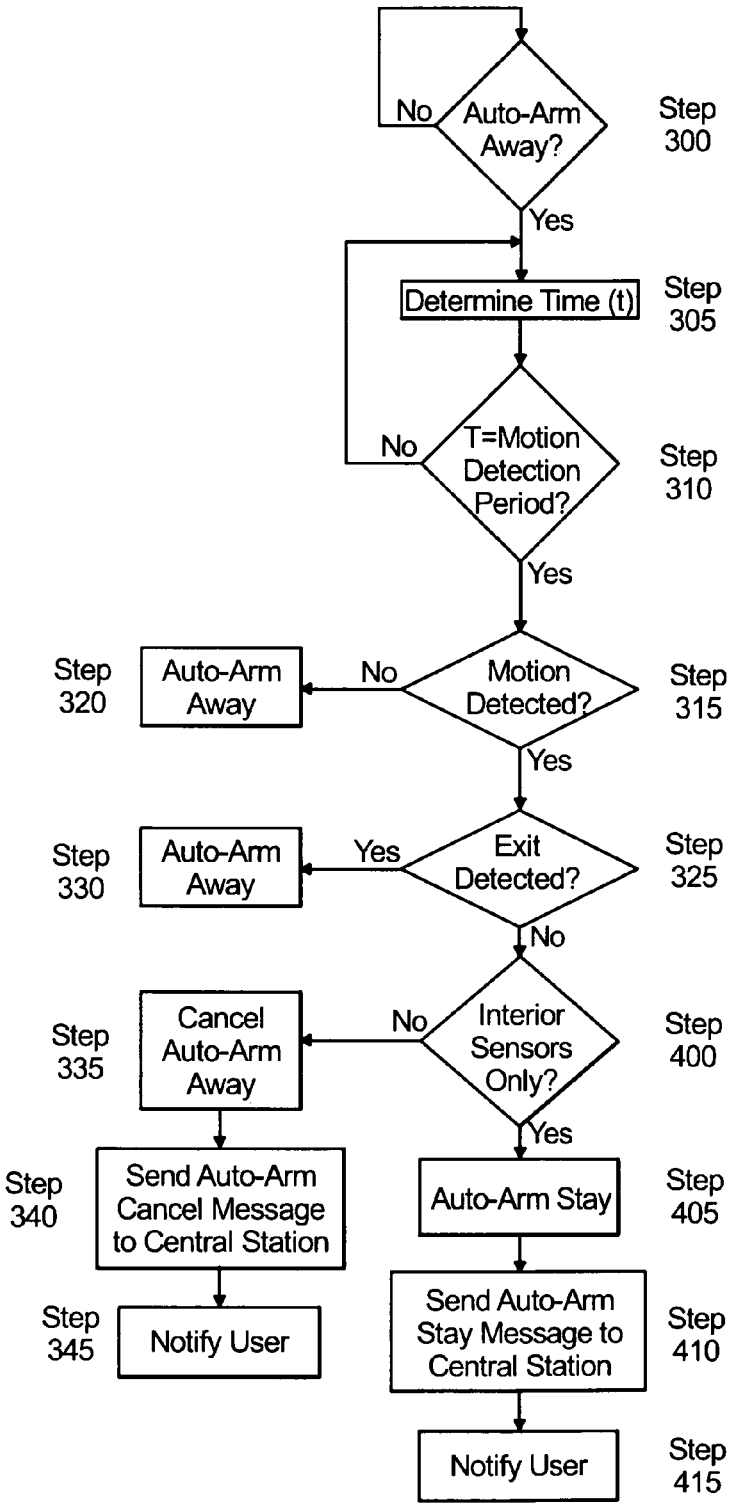
FIG. 4 illustrates the method of reducing false alarms according to the second embodiment of the invention.

FIG. 4 illustrates the method of reducing false alarms according to the second embodiment of the invention. Steps 300-330 are the same as in the first embodiment and will not be described again.

In the second embodiment, instead of just canceling the auto-arm function if both motion is detected and no premises exit was detected, the control panel 110 will determine the location of the detected motion and based upon this determination, either cancel the auto arm away (and stay) or allow an auto-arm stay. By allowing for the execution of an auto-arm stay at least part of the security system 100 is armed and some protection is provided.

The control panel 110 will prevent the system from executing the auto-arm away mode if the perimeter sensors 160 detect an event such as a door opening, a window being opened or a window being broken, however, if only the interior sensors 150 detect motion, the control panel 110 will allow the system to execute an auto-arm stay mode. In arm, stay mode, any detected motion by the interior sensors 150 will be ignored and an alarm will not be generated whereas, any detected event by the perimeter sensors 160 will generate an alarm. Therefore, even if there is motion within the premises, some protection can be afforded to the user. False alarms will be reduced because if the perimeter sensors 160 detect an event, the auto-arm away mode will not be activated.

At step 400, the control panel 110 will determine which sensor, i.e., perimeter 160 and interior 150 detected the event, i.e., motion in the case of the interior sensors 150 and open or close of a window or door in the case of a perimeter sensor. If the sensor was an interior sensor 150 only, then the control panel 110 will automatically arm the system in armed, stay mode when the current time reaches the scheduled time for auto-arm away, at step 405. Once the system is armed in the stay mode, then the control panel 110 can transmit message to the central monitoring station to indicate that the system was armed in stay mode. This message can be transmitted at step 410. This control panel 110 can notify the security system owner, at step 415, in a similar manner as step 345. Additionally, the person(s) or occupant of the premises would hear an audible tone indicating that the system armed in stay mode. The person would be able to take any necessary actions such as leave, disarm the system or arm away if necessary. If the sensor that detected the event was a perimeter sensor 160 or both interior 150 and perimeter 160 sensors, then the control panel 110 will cancel the auto-arm, at step 335. The remaining steps of the process are the same as the first embodiment and will not be described, i.e., steps 340 and 345.

In the third embodiment, the control panel 110 will cancel the scheduled auto-arm away immediately if any motion is detected during the predefined detection period or auto-arm warning period. No premises exit signal is needed. No type of auto-arming will occur.

Figure 5:
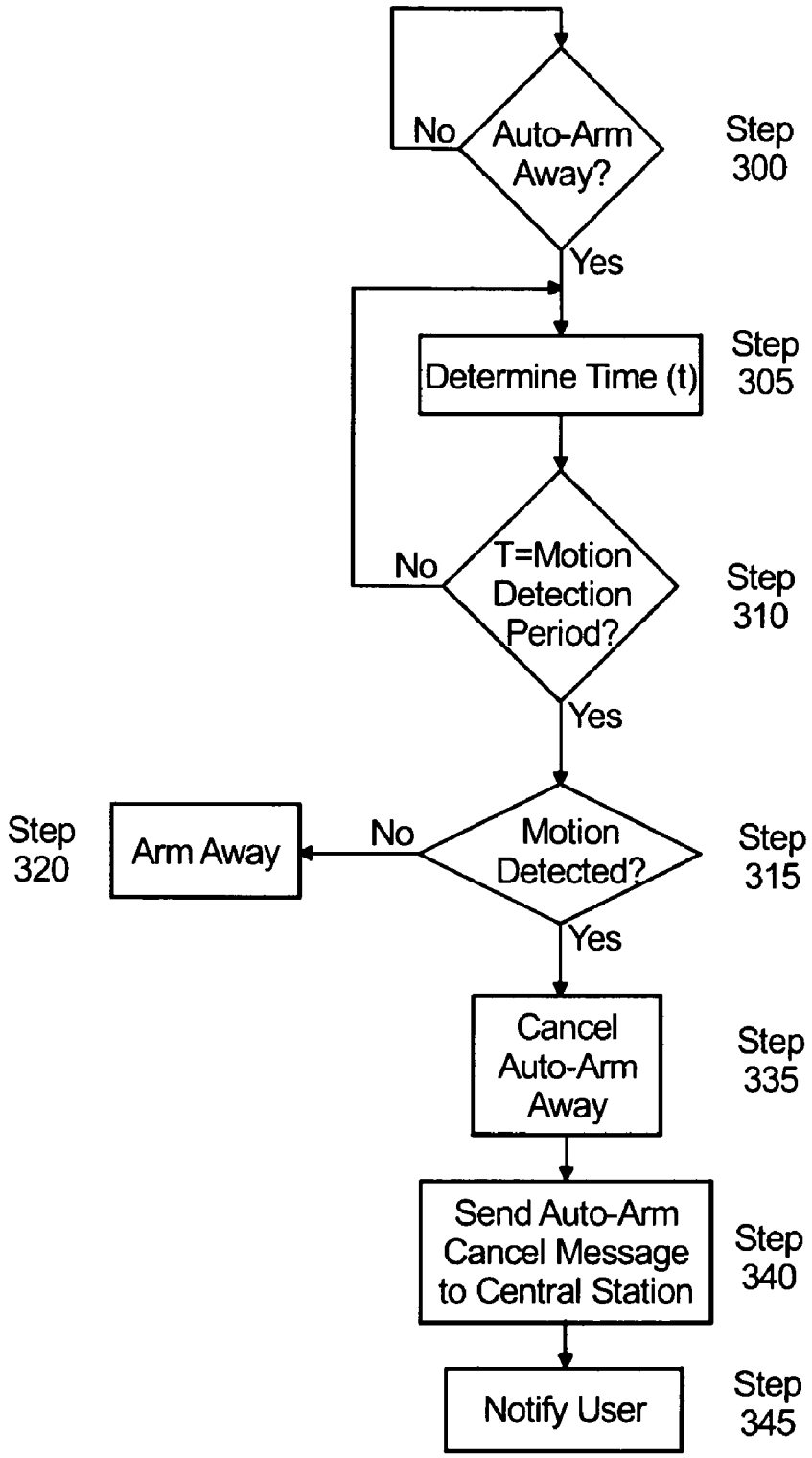
FIG. 5 illustrates the method of reducing false alarms according to the third embodiment of the invention.

FIG. 5 illustrates the false alarm reducing method according to the third embodiment. Steps 300-320 are the same as the first two embodiments and will not be described. As illustrated in FIG. 5, steps 325 and 330 are eliminated. If any motion is detected the process proceeds directly to step 335. The scheduled auto-arm away mode is cancelled.

Figure 6:
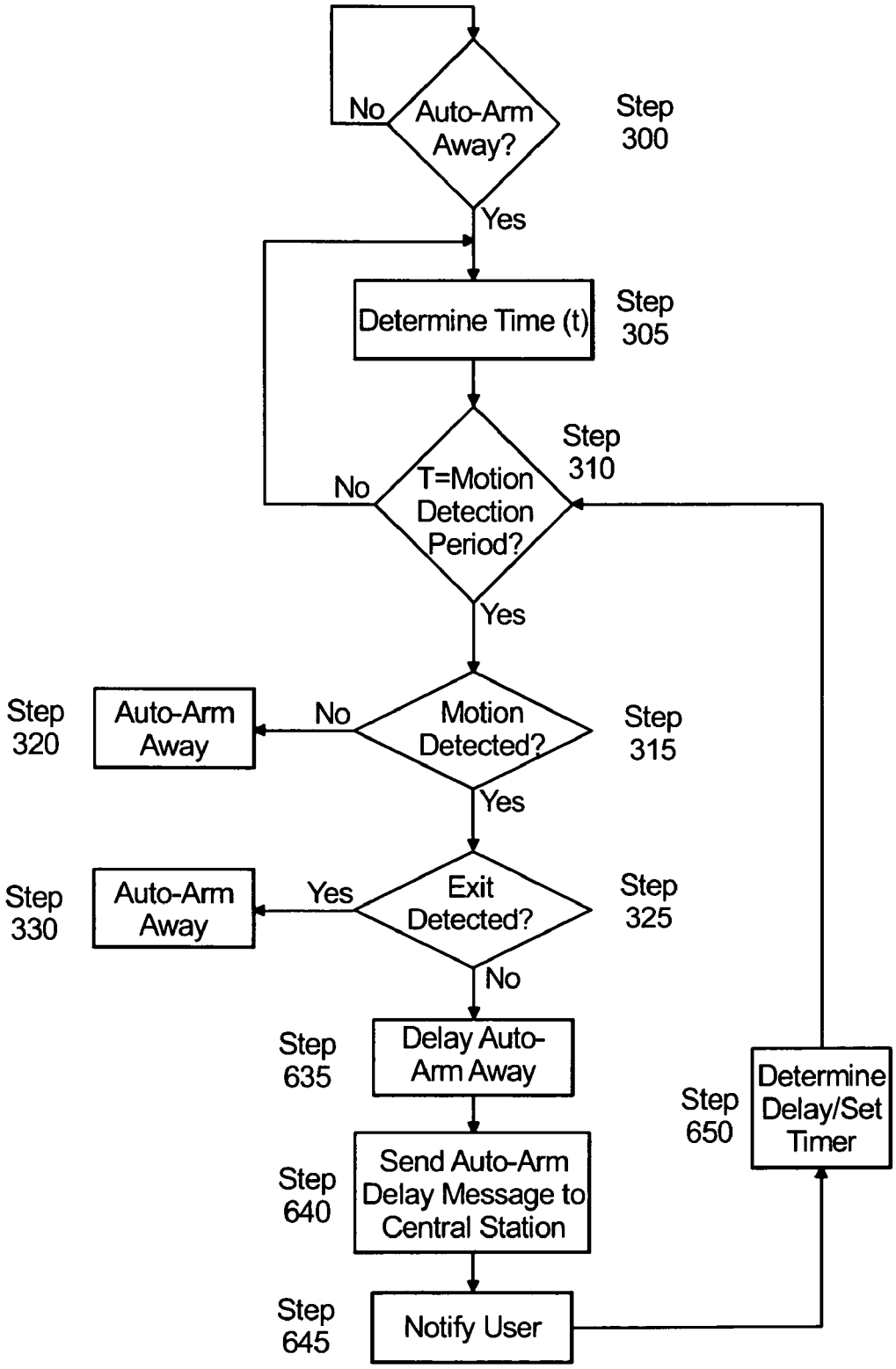
FIG. 6 illustrates the method of reducing false alarms according to the fourth embodiment of the invention.

FIG. 6 illustrates the false alarm reducing method according to the fourth embodiment of the invention. Steps 300-330 are the same as the first two embodiments and will not be described again. According to the fourth embodiment of the invention, the auto-arm function can be delayed if motion is detected and a premises exit signal was not detected. The delay of the auto arm away function occurs at step 635. The delay can be for a predetermined period of time. For example, the predetermined time can be 30 minutes. The predetermined period of time for the delay can be a default time set at installation or set by a user or owner of the security system 100. When the auto-arm away function is delayed at step 635, the security system will send a delay message to the central station at step 640 and notify the user or security system owner at step 645.

At step 650, the security system will determine what the delay period or delay time should be. Specifically, the central section 102 will look into the memory 114 to see what the predetermined period of time is and set a timing means with the predetermined period of time. The timing means will count period of time. Once the period of time has elapsed, the process will proceed to step 310 and all steps after step 310 will be repeated. This process can be repeated until the system does not detect motion without a premise exit, i.e., until the system can auto-arm-away. Alternatively, the process can be repeated for N times. After N times, if motion is still detected, the auto-arm away function can be cancelled. If the auto-arm function is cancelled, the security system will send cancel message to the central station and notify the user in a similar as 340 and 345 of the first embodiment.

The delay function of the fourth embodiment can be combined with the second and third embodiments, to delay the auto-arm function instead of canceling the function. For example, Steps 635-650 can replace Steps 335-345 in FIG. 4.

Additionally, Steps 635-650 can replace Steps 335-345 in FIG. 5.

The invention has been described herein with reference to particular exemplary embodiments. Certain alterations and modifications may be apparent to those skilled in the art, without departing from the scope of the invention. The exemplary embodiments are meant to be illustrative, not limiting of the scope of the invention, which is defined by the appended claims.

What is claimed is:

1. A method for reducing false alarms for a security system when said security system is programmed to automatically arm said security system, the method comprising the steps of:

a) determining if a current time equals or is within a predetermined detection period;

b) judging whether at least one of a plurality of motion sensors have detected an event within a protected area during said predetermined detection period;

c) determining if a premises exit signal has been generated within a predetermined period from said detected movement;

d) generating an automatic arm adjustment signal based upon said detected event and said premises exit signal; and e) executing a modification to said programmed automatic arm based upon said automatic arm adjustment signal.

2. The method for reducing false alarms according to claim 1, wherein if both the event is detected and no premises exit signal has been generated, said automatic arm adjustment signal causes said security system to cancel the automatic arm.

3. The method for reducing false alarms according to claim 1, wherein said method further comprises the step of determining a type of said at least one of said plurality of motion sensors that detected the event.

4. The method for reducing false alarms according to claim 3, wherein said type is either interior sensor or perimeter sensor.

5. The method for reducing false alarms according to claim 4, wherein if said at least one of said plurality of motion sensors that detected the event is determined to be said interior sensor only and no premises exit signal has been generated then said automatic arm adjustment signal causes said security system to execute said automatic arm of said security system in arm-stay mode.

6. The method for reducing false alarms according to claim 1, wherein said method further includes the steps of:

transmitting a message to a central monitoring station indicating the executed modification to said programmed automatic arm; and notifying an owner of said protected area that modification to said programmed automatic arm was executed.

7. The method for reducing false alarms according to claim 6, wherein said notification includes transmitting a text message, email or audible page sent to a programmed contact parameter.

8. The method for reducing false alarms according to claim 1, wherein if both the event is detected and no premises exit signal has been generated, said automatic arm adjustment signal causes said security system to delay the automatic arm.

9. The method for reducing false alarms according to claim 8, wherein the delay is for a predetermined period of time.

10. The method for reducing false alarms, according to claim 9, wherein after said predetermined period of time elapses, steps (b) through (e) are repeated.

11. The method for reducing false alarms according to claim 10, wherein the repetition is for N times, wherein N is an integer, if after N times the event is still detected, said automatic arm adjustment signal causes said security system to cancel the automatic arm.

12. A method for reducing false alarms for a security system when said security system programmed to automatically arm said security system, the method comprising the steps of:

determining if a current time equals or is within a predetermined detection period;

judging whether one of a plurality of motion sensors have detected an event within a protected area during said predetermined detection period; and canceling said automatic arm if any of said plurality of motion sensors detects the event.

13. The method for reducing false alarms according to claim 12, wherein said method further includes the steps of:

transmitting a message to a central monitoring station indicating the cancellation of said programmed automatic arm; and notifying an owner of said protected area that programmed automatic arm was cancelled.

* * * * *